US008512099B2

(12) United States Patent
Kerstan et al.

(10) Patent No.: US 8,512,099 B2
(45) Date of Patent: Aug. 20, 2013

(54) METHOD FOR THE SIMULTANEOUS DOUBLE-SIDED MATERIAL REMOVAL PROCESSING OF A PLURALITY OF SEMICONDUCTOR WAFERS

(75) Inventors: Michael Kerstan, Burghausen (DE); Georg Pietsch, Burghausen (DE); Frank Runkel, Tetenhusen (DE); Conrad von Bechtolsheim, Fockbek (DE); Helge Moeller, Flensburg (DE)

(73) Assignees: Siltronic AG, Munich (DE); Peter Wolters GmbH, Rendsburg (DE)

( * ) Notice: Subject to any disclaimer, the term of this patent is extended or adjusted under 35 U.S.C. 154(b) by 859 days.

(21) Appl. No.: 12/581,195

(22) Filed: Oct. 19, 2009

(65) Prior Publication Data

US 2010/0099337 A1 Apr. 22, 2010

(30) Foreign Application Priority Data

Oct. 22, 2008 (DE) ..... 10 2008 052 793
Dec. 3, 2008 (DE) ..... 10 2008 061 038

(51) Int. Cl.
*B24B 1/00* (2006.01)

(52) U.S. Cl.
USPC ..... 451/36; 451/41; 451/57; 451/269

(58) Field of Classification Search
USPC ..... 451/41, 42, 57, 59, 262, 264, 268, 451/269, 36
See application file for complete search history.

(56) References Cited

U.S. PATENT DOCUMENTS

| | | | | |
|---|---|---|---|---|
| 5,769,694 | A | 6/1998 | Hesse et al. | |
| 5,958,794 | A | 9/1999 | Bruxvoort et al. | |
| 6,007,407 | A | 12/1999 | Rutherford et al. | |
| 6,206,767 | B1 | 3/2001 | Suzuki et al. | |
| 6,447,382 | B1 | 9/2002 | Potempka | |
| 6,599,177 | B2 | 7/2003 | Nevoret et al. | |
| 6,830,505 | B2 * | 12/2004 | Kobayashi et al. | 451/262 |
| 7,029,380 | B2 * | 4/2006 | Horiguchi et al. | 451/262 |
| 7,364,495 | B2 * | 4/2008 | Tominaga et al. | 451/41 |
| 2002/0115387 | A1 * | 8/2002 | Wenski et al. | 451/41 |
| 2004/0043713 | A1 * | 3/2004 | Moriya et al. | 451/262 |
| 2005/0124264 | A1 * | 6/2005 | Tominaga et al. | 451/41 |
| 2005/0202757 | A1 | 9/2005 | Junge et al. | |
| 2008/0014839 | A1 | 1/2008 | Pietsch et al. | |
| 2008/0233840 | A1 | 9/2008 | Pietsch et al. | |

FOREIGN PATENT DOCUMENTS

| | | | |
|---|---|---|---|
| DE | 29520741 | U1 | 5/1995 |
| DE | 10007389 | A1 | 5/2001 |
| DE | 10159848 | B4 | 7/2004 |
| DE | 10218483 | B4 | 9/2004 |
| DE | 10344602 | A1 | 5/2005 |
| DE | 102006032455 | A1 | 4/2008 |

(Continued)

*Primary Examiner* — Timothy V Eley
(74) *Attorney, Agent, or Firm* — Brooks Kushman P.C.

(57) ABSTRACT

A device for double-sided processing of flat workpieces has upper and lower working discs forming between them a working gap containing a carrier disc with cutout(s) for workpiece(s), the carrier disc having circumferential teeth by means of which it rolls on an inner and an outer gear wheel or pin ring, wherein the gear wheels or pin rings have a multiplicity of gear or pin arrangements which engage the teeth of the carrier discs during rolling, at least one of the pin arrangements having a guide which delimits movement of the margin of the carrier disc in at least one axial direction, the guide formed by a circumferential shoulder or a circumferential groove.

13 Claims, 9 Drawing Sheets

(56) References Cited

FOREIGN PATENT DOCUMENTS

| | | | |
|---|---|---|---|
| DE | 102007013058 | A1 | 9/2008 |
| EP | 0787562 | A1 | 8/1997 |
| EP | 0924030 | A2 | 6/1999 |
| EP | 0945219 | A1 | 9/1999 |
| EP | 1688218 | A1 | 9/2006 |
| JP | 07237119 | A | 9/1985 |
| JP | 64002861 | A | 1/1989 |
| JP | 11254303 | A | 9/1999 |
| JP | 2000141213 | A | 5/2000 |
| JP | 2003300152 | A | 10/2003 |
| JP | 2004087521 | A | 3/2004 |
| JP | 2008012623 | A | 1/2008 |
| TW | 410187 | | 8/1998 |

* cited by examiner

Fig. 9A
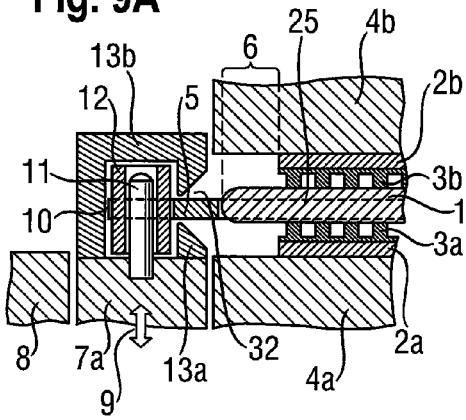
Fig. 9B
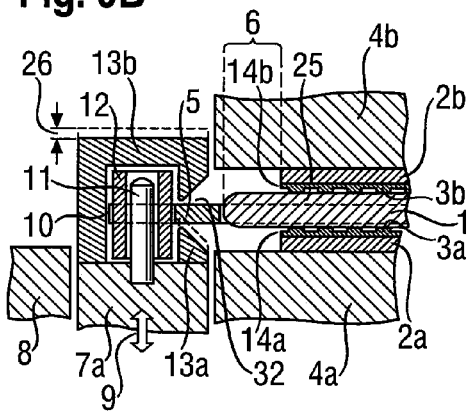
Fig. 9C
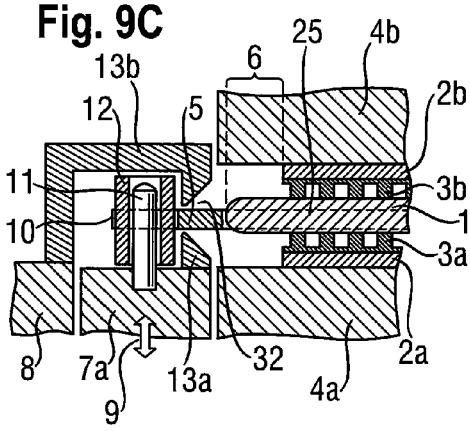
Fig. 9D
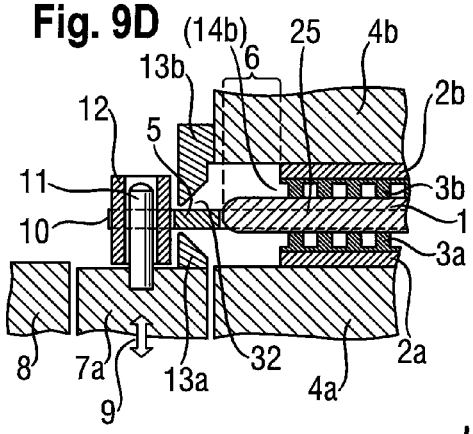
Fig. 9E
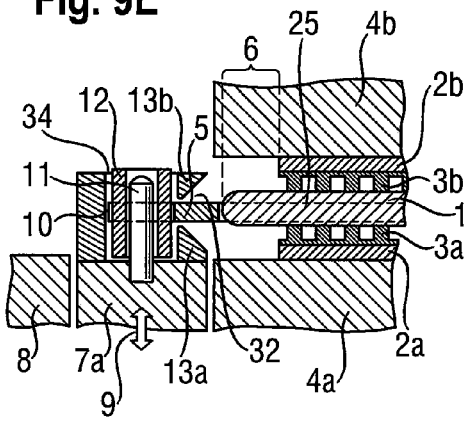
Fig. 9

Fig. 10A
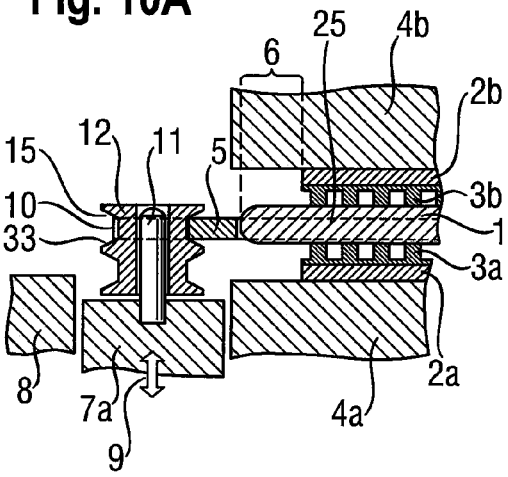
Fig. 10B
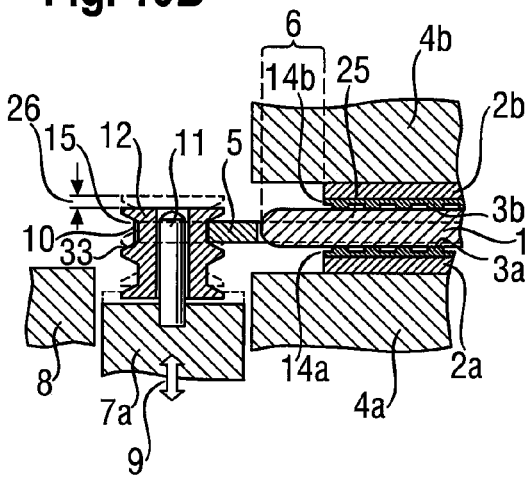
Fig. 10C
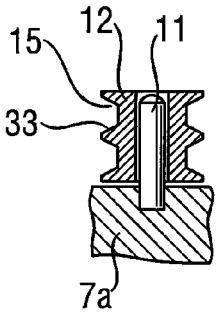
Fig. 10D
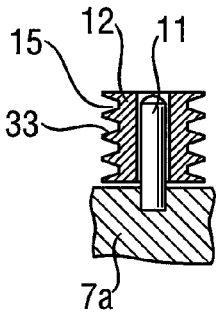
Fig. 10E
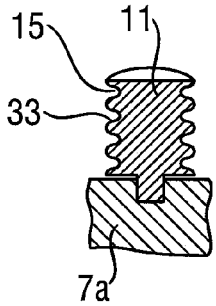
Fig. 10F
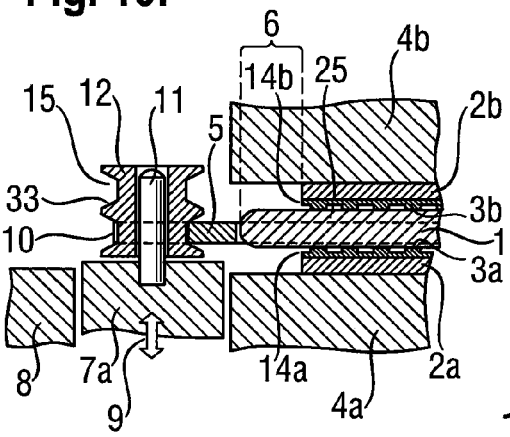
Fig. 10

Fig. 11A
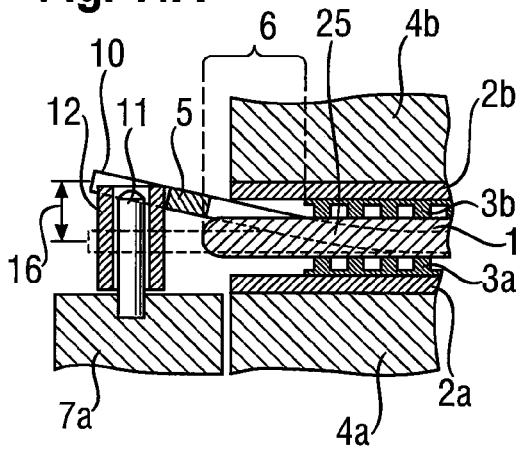
Fig. 11B
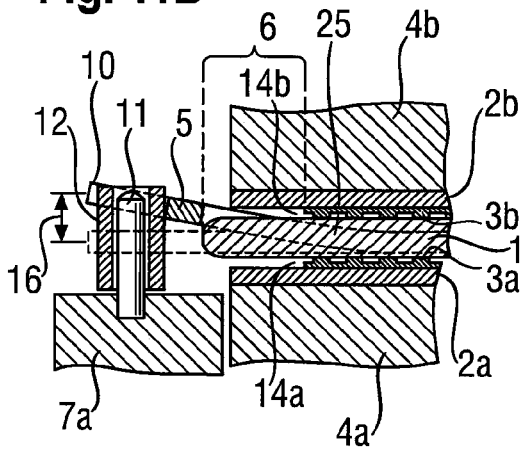
Fig. 11C
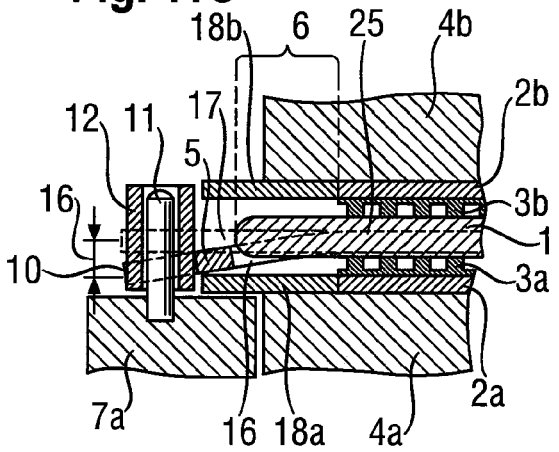
Fig. 11

Fig. 12A
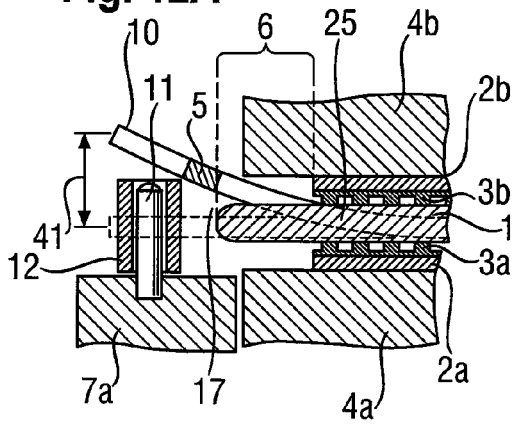
Fig. 12B
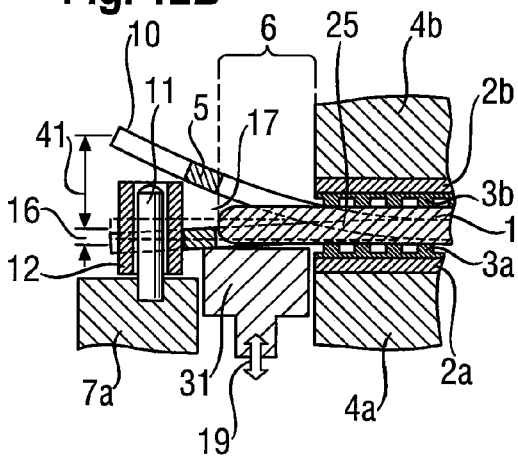
Fig. 12C
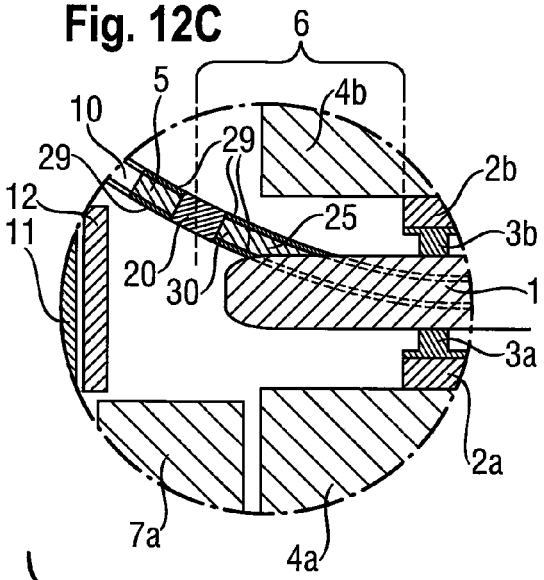
Fig. 12D
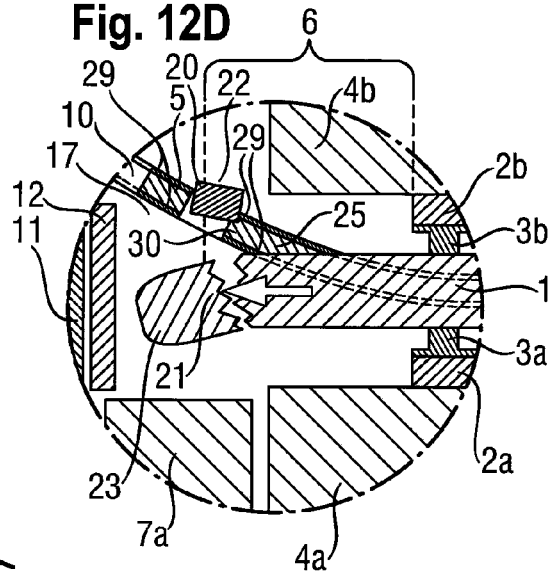
Fig. 12
PRIOR ART Fig. 13A
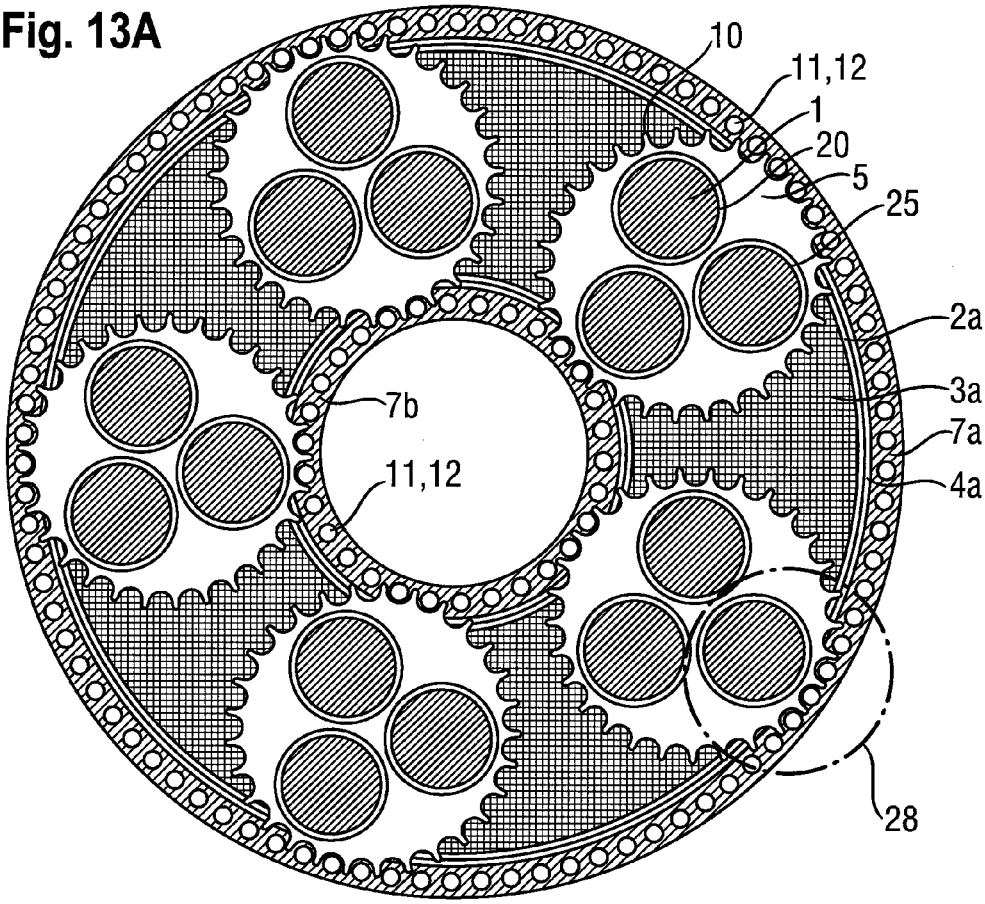
Fig. 13B
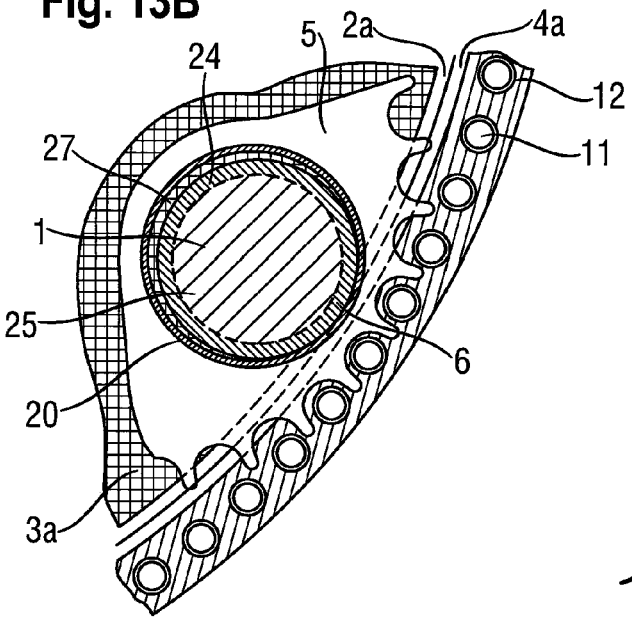
Fig. 13

Fig. 14A
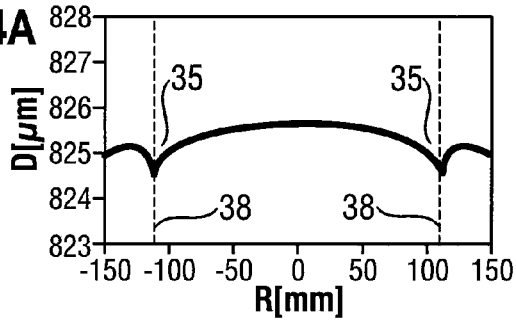
Fig. 14B
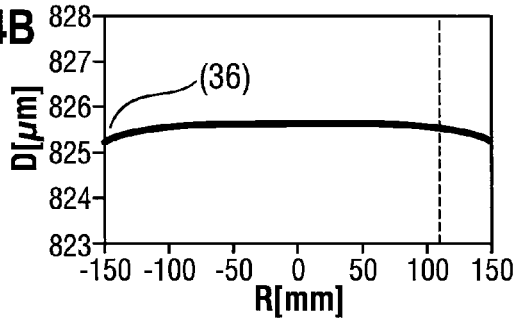
Fig. 14
Fig. 14C
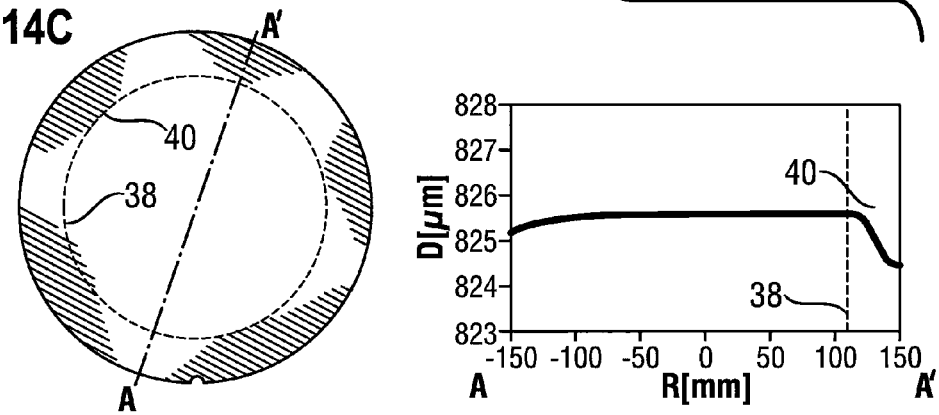
Fig. 14D
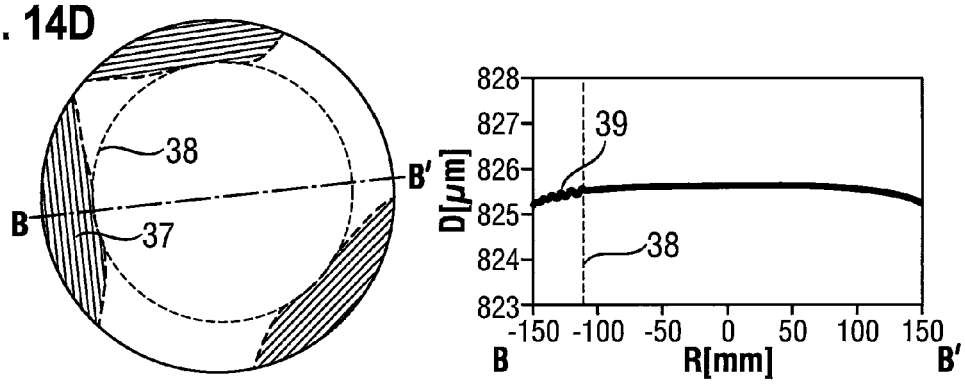

METHOD FOR THE SIMULTANEOUS DOUBLE-SIDED MATERIAL REMOVAL PROCESSING OF A PLURALITY OF SEMICONDUCTOR WAFERS

This application claims priority to German application DE 10 2008 052 793.9 filed Oct. 22, 2008, and application DE 10 2008 061 038.0 filed Dec. 3, 2008, which are herein incorporated by reference.

BACKGROUND OF THE INVENTION

1. Field of the Invention

The invention relates to a device for the double-sided processing of flat workpieces, comprising upper and lower working discs, at least one of the discs being driven in rotary fashion by means of a drive, and which between themselves form a working gap in which is arranged a carrier disc with a cutout for at least one workpiece to be processed, wherein the carrier disc has teeth on its circumference by means of which it rolls on an inner and an outer gear wheel or pin ring if at least one of the gear wheels or pin rings is set in rotation, wherein the gear wheels or pin rings each have a multiplicity of gear or pin arrangements which the teeth of the carrier discs engage during rolling.

2. Background Art

With devices of this type, flat workpieces, for example semiconductor wafers, can be subjected to material removal processing, for example honing, lapping, polishing or grinding. For this purpose, the workpieces are held in floating fashion in cutouts in carrier discs guided in rotary fashion in the working gap and are simultaneously processed on both sides. In this case, the workpieces describe a cycloid movement in the working gap. With such devices, flat workpieces can be processed on both sides in a highly precise manner.

The contact between the outer teeth of the carrier discs and the teeth of the gear wheels or the pins of the pin rings results in wear on the gears or pins. It is therefore known from DE 295 20 741 U1 to mount sleeves in rotatable fashion on the pins of pin rings, wherein the carrier discs come into engagement with the sleeves. In the case of an embodiment of this type, frictional stress no longer occurs between the carrier disc teeth and the pins. Rather, such contact takes place between the sleeve and the pin. However, since the sleeve bears on the pin over a much greater length, the surface loading and hence the possible abrasion are correspondingly lower. Furthermore, the sleeves can be replaced in a simple manner in the event of wear. By contrast, replacing the pins is comparatively complicated. Further configurations of such sleeves have been disclosed by DE 101 59 848 B1 and DE 102 18 483 B4. EP 0 787 562 B1 discloses sleeves composed of a plastic material.

In the case of the known devices, one problem is that the loading of the carrier discs on account of contact with the gears or pins and sleeves can lead to the teeth of the carrier disc being bent away upward or downward, which regularly leads to damage to the workpieces and also the working discs or their working layers. On account of the low strength, this is particularly critical in the case of plastic carrier discs that are otherwise desired. Moreover, premature wear of the carrier discs can occur in the case of the known devices. This is because the carrier disc partially leaves the working gap, in particular in the region of the gear wheels or pin rings, which can perform undesirable vertical movements owing to the lack of guidance there by the working gap. When this part of the carrier disc reenters the working gap, these movements lead to undesirable contact between the carrier disc surface and the edge of the working discs or their working layer, as a result of which intensified wearing of the carrier disc surface occurs.

The present invention also relates to a method for the simultaneous double-sided material removal processing of a plurality of semiconductor wafers, in which each semiconductor wafer lies freely mobile in a recess of one of a plurality of carrier discs set in rotation by means of an annular outer wheel or pin ring and an annular inner gear wheel or pin ring and thereby moves on a cycloid path curve, while the semiconductor wafers are processed so as to remove material between two rotating annular working discs, and the carrier discs and/or semiconductor wafers temporarily leave the working gap, delimited by the working discs, with a part of their surface during the processing.

For electronics, microelectronics and micro-electromechanics, semiconductor wafers with extreme requirements for global and local planarity, one-side referenced local planarity (nanotopology), roughness and cleanness are used as starting materials (substrates). Semiconductor wafers are wafers of semiconductor materials, in particular compound semiconductors such as gallium arsenide or elementary semiconductors such as silicon and germanium.

According to the prior art, semiconductor wafers are produced in a multiplicity of successive process steps. In general, the following production sequence is used:

- production of a monocrystalline semiconductor rod (crystal growth),
- cutting the rod into individual wafers (internal hole or wire sawing),
- mechanical wafer preparation (lapping, grinding),
- chemical wafer preparation (alkaline or acid etching)
- chemo-mechanical wafer preparation: double-sided polishing (DSP)=stock polishing, single-sided haze-free or mirror polishing with a soft polishing pad (CMP)
- optionally further processing or coating steps (for example epitaxy, annealing)

Mechanical processing of the semiconductor wafers serves primarily for global planarization of the semiconductor wafer, and also for thickness calibration of the semiconductor wafers as well as removal of the crystalline-damaged surface layer and of processing traces (sawing cuts, incision marks) caused by the previous cutting process.

Methods known in the prior art for mechanical wafer preparation are single-sided grinding (SSG) with a cup grinding disc which contains a bound grinding agent, simultaneous grinding of both sides of the semiconductor wafer together between two cup grinding discs ("double-disc grinding", DDG) and lapping both sides of a plurality of semiconductor wafers simultaneously between two annular working discs while supplying a slurry of free grinding agent (double-sided plane-parallel lapping, "lapping").

DE 103 44 602 A1 and DE 10 2006 032 455 A1 disclose methods for simultaneously grinding both sides of a plurality of semiconductor wafers together with a movement process similar to that of lapping, but characterized by the use of a grinding agent which is bound firmly in working layers ("films", "pads") which are applied onto the working discs. Such a method is referred to as "fine grinding with lapping kinematics" or "planetary pad grinding" (PPG).

Working layers used in PPG, which are adhesively bonded onto the two working discs, are described for example in U.S. Pat. No. 6,007,407 A and U.S. Pat. No. 6,599,177 B2. During the processing, the semiconductor wafers are placed into thin guide cages, so-called carrier discs, which have corresponding openings for receiving the semiconductor wafers. The carrier discs have outer teeth, which engage in a rolling device comprising an inner and outer gear wheel and are moved thereby in the working gap formed between the upper and lower working discs.

The ability to carry out the PPG method is crucially determined by the properties of the carrier discs and their guiding during the rolling movement. The semiconductor wafers must temporarily leave the working gap with a part of their surface during the processing. This temporary projection of a part of the area of the workpieces from the working gap will be referred to as the "workpiece excursion". The latter ensures that all regions of the tool are used uniformly and experience uniform wear which preserves their shape, and the desired plane-parallel shape is imparted to the semiconductor wafers without "balling" (thickness reduction toward the margin of the semiconductor wafer). The same applies similarly for lapping with a free lapping abrasive.

The methods of PPG grinding known in the prior art, for example as described in DE 103 44 602 A1 and DE 10 2006 032 455 A1, are however disadvantageous in this regard. With the methods known from the prior art, it is not possible to provide semiconductor wafers with sufficient planarity as far as the outermost marginal region, which are suitable for particularly demanding applications and future technology generations.

Specifically, it has been found that the carrier discs are susceptible to vertical dislocation from their central position until they disengage from the rolling device owing to strong bending. This is to be expected in particular when high or strongly alternating process forces act on the carrier discs as in the case of high removal rates, unfavorably selected process kinematics, or when using particularly fine abrasives in the grinding pad.

The dislocation of the carrier discs is promoted because they have only a small total thickness (at most slightly greater than the final thickness of the semiconductor wafers to be processed) and thus have only a limited strength against bending. Furthermore, the carrier disc is conventionally made of a steel core which is provided with a protective layer. Direct contact of the steel core and the abrasive preferably used in PPG, i.e. diamond, leads to wear of the microedges of the diamond grains owing to the high solubility of carbon in iron, and therefore rapid loss of the cutting acuity of the working layers being used.

Frequent sharpening associated with high wear of the working layers, with the concomitant unstable process management, would also compromise the properties of the semiconductor wafers thereby processed and therefore make the use of PPG methods not only uneconomical, but possibly even unviable for future technology generations.

As is known, the protective layers applied onto the steel core of the carrier disc experience wear. They should therefore have a usable thickness which is as large as possible, in order to allow economical lifetimes of the consumable constituted by the "carrier disc". The protective layers are furthermore required in order to achieve low sliding friction between the working layers and the carrier discs. Suitable layers consist, for example, of polyurethane. The layer is conventionally soft and does not therefore contribute to the stiffness of the carrier disc. The remaining steel core is therefore much thinner than the target thickness of the semiconductor wafers after the processing by means of PPG.

If the target thickness of a semiconductor wafer with a diameter of 300 mm after processing by means of PPG is for example 825 μm and the total thickness of the carrier disc being used is 800 μm, then 500-600 μm of this 800 μm total thickness of the carrier disc is given over to the steel core which imparts stiffness, and 100-150 μm each to the anti-wear coating on the two sides.

If for comparison the target thickness of the semiconductor wafer after processing by means of lapping is likewise 825 μm, then the carrier disc used for the lapping consists entirely of stiffness-imparting steel and has a thickness of 800 μm.

Since the bending of a plate, for the same material and the same shape and design, is known to vary with the third power of its thickness, a carrier disc with a 500 μm thick steel core bends during PPG about four times as much as an 800 μm thick carrier disc during lapping.

For a carrier disc with a 600 μm thick steel core, the bending during PPG is still 2.4 times that of an 800 μm thick carrier disc during lapping.

In the working gap, the maximum deviation from the plane setting of the carrier disc is limited by the difference between the carrier disc thickness and instantaneous thickness of the semiconductor wafers. This is typically at most 100 μm. Wherever the carrier disc projects inward and outward from the annular working gap and engages into the rolling device comprising the inner and outer pin ring, no measures are implemented in the prior art of PPG methods to limit the possible bending of the carrier disc. Owing to the workpiece excursion required, this unguided region is particularly large.

Bending of the carrier discs leads to the following disadvantages for the semiconductor wafers and for the carrier discs, and therefore to an unstable and critical overall process:

a) The semiconductor wafer always extends partially from the reception opening of the carrier disc and is forced back in when it re-enters the working gap. This also bends the semiconductor wafer and presses it onto the outer or inner edge of the grinding pad. This can lead to the formation of local scratches and geometrical defects in the marginal region owing to the increased grinding effect.

b) The continual insertion and extraction of the semiconductor wafer into and from the bent carrier disc roughens the reception opening of the carrier disc, which is generally lined with an insert made of a soft plastic. Sometimes, the lining of the reception opening may even be torn out of the carrier disc. In any event, the service life of the carrier discs being used suffers detrimentally.

c) The roughened lining of the reception opening of the carrier disc brakes or stops the desired free rotation of the semiconductor wafers inside the reception opening. This can lead to planarity defects of the semiconductor wafer in respect of global planarity (for example TTV=total thickness variance) and local planarity (nanotopography).

d) The carrier disc, bent in its excursion, exerts high forces on the grinding bodies when it re-enters the working gap, in particular on the outer and inner edges of the annular working layer. The working layer can thereby be damaged. Entire grinding bodies ("tiles") can be torn out, or at least parts thereof can be displaced. If these fragments enter between the semiconductor wafer and the working layer, fracture of the semiconductor wafer is possible owing to the high point loading.

e) The bending of the carrier disc, with increased point loading of its protective layer at the points which sweep over the edge of the working layer, leads to greatly increased local wear. This considerably limits the lifetime of the carrier disc and makes the method uneconomical. The increased wear of the protective layer furthermore makes the working layer blunt. This necessitates frequent resharpening processes which consume time and material, and are therefore detrimental to the economic viability of the method.

Furthermore, the frequent process interruptions have a negative effect on the properties of the semiconductor wafers thus processed.

JP 11254303 A2 discloses a device for guiding the carrier discs, which consists of two upper and lower spacers which converge conically or in a wedge shape and which are arranged on the inner margin of an outer gear wheel of the lapping machine. The deformation of thin carrier discs is intended to be able to be prevented by means of such a device. However, the modification described therein for the lapping machine, which moreover is directed at the processing of glass substrates, has substantial disadvantages and is unsuitable for carrying out methods of lapping and PPG grinding with workpiece excursion.

Both when lapping with free cutting abrasive in a slurry and for PPG grinding with abrasive bound firmly in grinding pads, the working layers (cast-metal lapping plates or grinding pad) experience constant wear. The height of the lapping plate or grinding pad decreases continuously and the position of the plane, in which the carrier discs move in the working gap formed between the lapping plates or grinding pads, is displaced progressively.

With increasing wear of the working layer and displacement of the movement plane of the carrier discs, the forcible guiding device disclosed in JP 11254303 A2 constrains the toothed outer region of the carrier discs to roll increasingly in a different plane. This means that the wedge-shaped guide blocks, screwed firmly to the outer toothed wheel, would additionally bend the carrier disc with increasing wear of the working disc, which is disadvantageous. Another disadvantage is that the guide blocks need to be unscrewed before it is possible to change the carrier disc, which is necessary from time to time. This represents additional outlay.

In PPG grinding methods, carrier discs are conventionally used with a coating, which is necessary in order to avoid direct contact between the stiffness-imparting core of the carrier disc and the abrasive of the grinding pad (for example diamond). Owing to the design, the spacers described in JP 11254303 A2 engage far into the carrier disc and in each case sweep over the coating of the carrier disc in its marginal region. Owing to the vertical constraining forces which occur during the guiding of the carrier disc, the coating of the carrier discs is therefore exposed to particularly high wear in the guided region, when a device according to JP 11254303 A2 is employed. Another disadvantage of using the solution proposed in JP 11254303 A2 for PPG methods is therefore that the guide ring is engaged far into the carrier disc and can thus damage the carrier disc coating (for example polyurethane).

No satisfactory solution to the problem of carrier disc bending in the region of the workpiece excursion is therefore known from the prior art.

SUMMARY OF THE INVENTION

It is an object of the present invention to provide a suitable device with which the wear and the risk of damage of the carrier discs and of the workpieces (e.g. semiconductor wafers) can be minimized, and furthermore a method for the simultaneous double-sided material removal processing of a plurality of semiconductor wafers, which prevents the carrier disc from bending out of the movement plane in the region of the workpiece excursion.

These and other objects are achieved, firstly, by means of a device for the double-sided processing of flat workpieces (1), comprising an upper working disc (4*b*) and a lower working disc (4*a*), wherein at least one of the working discs (4*a*, 4*b*) can be driven in rotary fashion by means of a drive, and wherein the working discs (4*a*, 4*b*), form between themselves a working gap (64), in which is arranged at least one carrier disc (5) with at least one cutout (25) for at least one workpiece (1) to be processed, wherein the at least one carrier disc (5) has teeth (10) on its circumference, by means of which teeth it rolls on an inner and an outer gear wheel or pin ring (7*a*, 7*b*) if at least one of the gear wheels or pin rings (7*a*, 7*b*) is set in rotation, wherein the gear wheels or pin rings (7*a*, 7*b*) each have a multiplicity of gear or pin arrangements with which the teeth (10) of the carrier discs (5) enter into engagement during rolling, wherein at least one of the pin arrangements has at least one guide (48) which delimits a movement of the margin of the at least one carrier disc (5) in at least one axial direction, wherein one guide (48) is formed by at least one shoulder (50) extending around the circumference of the pin arrangement between a first, larger diameter and a second, smaller diameter of the pin arrangement and a further guide (48) is formed by the side surfaces (56, 58) of at least one groove (15) extending around the circumference of the pin arrangement.

BRIEF DESCRIPTION OF THE DRAWINGS

FIG. 9 shows by way of example the carrier disc guiding on the pin ring.

FIG. 10 shows embodiments of the carrier disc guiding according to the invention by means of grooved pin sleeves.

FIG. 11 shows an embodiment of the guiding of the carrier discs according to the invention by an annularly removed working layer of the working disc.

FIG. 12 shows the bending of the carrier discs in the prior art and guiding of the carrier disc by a support ring.

FIG. 13 shows an overall view of the lower working disc with a working layer, carrier discs, rolling device and semiconductor wafers FIG. 14 shows thickness profile and plan view of semiconductor wafers, which have been processed with guiding of the carrier discs according to the invention (14B) and not according to the invention (14A, 14C, 14D).

DETAILED DESCRIPTION OF THE PREFERRED EMBODIMENTS

Figure 1:
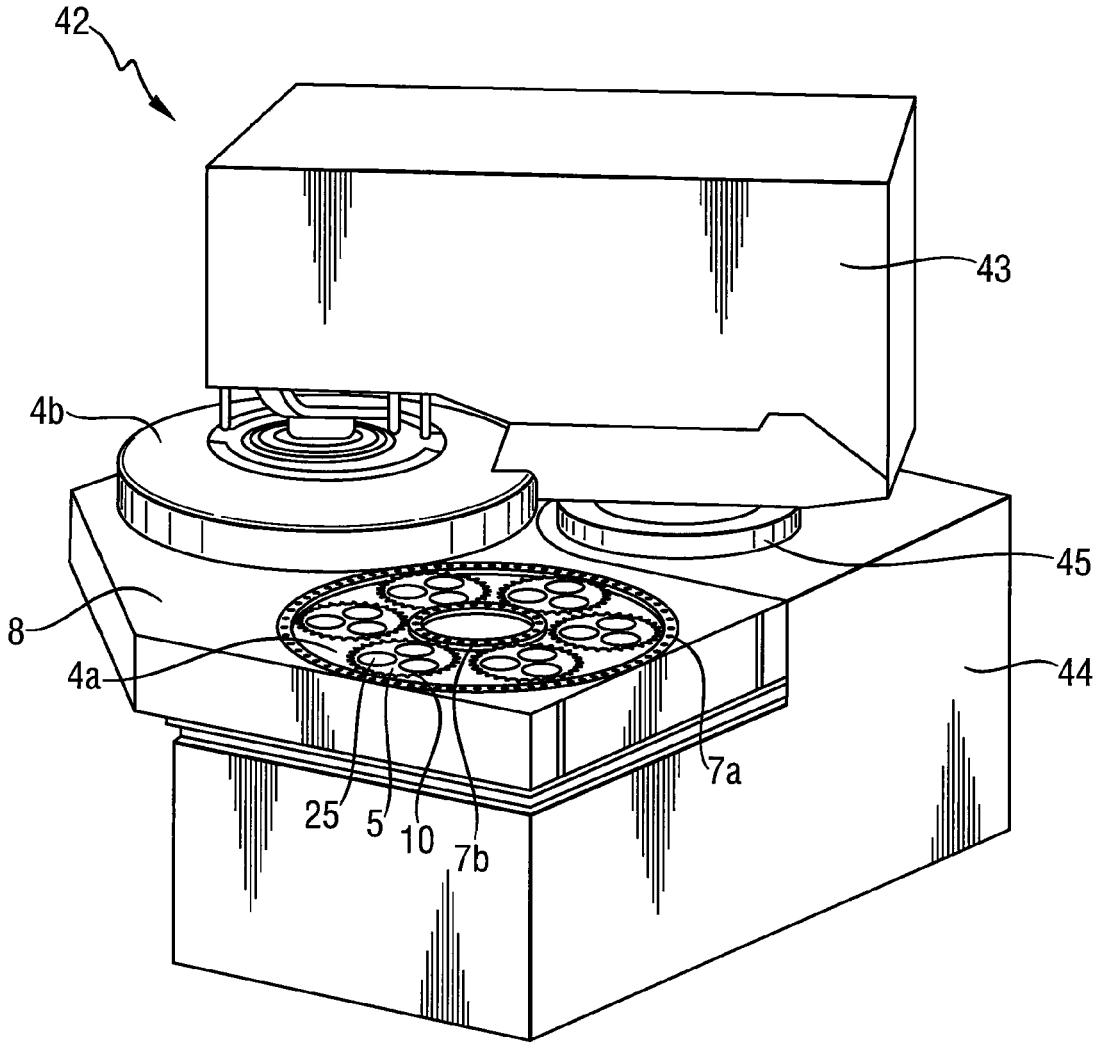
FIG. 1 shows the basic construction of a device according to the invention for the double-sided processing of flat workpieces in a perspective view.

The following is a list of references used in the specification:

1: workpiece (in particular semiconductor wafer)
2*a*: lower working layer carrier
2*b*: upper working layer carrier
3*a*: lower working layer
3*b*: upper working layer
4*a*: lower working disc

4*b*: upper working disc
5: guide cage for workpieces ("carrier disc")
6: workpiece excursion
7*a*: outer drive wheel (gear wheel/pin ring)
7*b*: inner drive wheel (gear wheel/pin ring)
8: machine base
9: pin ring height adjustment
10: outer teeth of the workpiece guide cage
11: pin
12: pin sleeve
13*a*: lower carrier disc guide
13*b*: upper carrier disc guide
14*a*: thickness decrease due to wear of the lower working layer
14*b*: thickness decrease due to wear of the upper working layer
15: groove
16: limited bending of the workpiece guide cage
17: projection of the workpiece from the guide cage
18*a*: separated workpiece carrier in the workpiece excursion/ring, bottom
18*b*: separated workpiece carrier in the workpiece excursion/ring, top
19: height adjustment of guide cage support ring
20: plastic molding ("insert")
21: migration of the workpiece from the guide cage
22: eruption of the plastic molding from the guide cage
23: fracture of the semiconductor wafer
24: marginal region of the semiconductor wafer, which enters excursion
25: reception opening for semiconductor wafer
26: readjustment of the guide device
27: play of the semiconductor wafer in the reception opening
28: excerpt (detailed representation)
29: anti-wear coating of the carrier disc
30: (steel) core of the carrier disc
31: support ring
32: opening of the guide device for the carrier discs
33: funnel-shaped groove opening
34: opening in the carrier disc guide for the pin sleeve
35: reduced thickness of the semiconductor wafer due to elevated grinding effect at the margin of the working layer
36: slight decrease in the thickness of the semiconductor wafer
37: processing traces (sawing cuts; anisotropic roughness)
38: region of the semiconductor wafer which sweeps over the margin of the working layer in the workpiece excursion
39: increased roughness
40: local decrease in the thickness of the semiconductor wafer in the marginal region.
41: unlimited deflection of the workpiece guide cage
42: double-sided processing machine
43: upper pivoting arm
44: base
45: pivoting device
46: rotation axis
48: guide of the sleeve
50: shoulder on the circumference of the sleeve
52: guide surface
56, 58: side surfaces of the groove
60: bevel at groove edge
62: workpiece
64: working gap The shoulder of the guide can particularly be perpendicular to a longitudinal axis of the pin arrangement or the sleeve respectively. The shoulder can also be formed by a sloped surface. The groove can also be perpendicular to the longitudinal axes of the pin arrangement or the sleeve respectively. The groove can have a square-shaped cross-section. The edges of the carrier discs are thereby guided by the side surfaces of the groove and therefore delimited in their movement on both sides in axial direction. The combination of shoulder and groove increases the flexibility of the use of the device as carriers with very different thicknesses can be used, wherein one type of carrier is guided in the groove and another, possibly much thicker type of carrier is guided by the shoulder.

The gear or pin arrangements according to the invention can have different diameters over their outer circumference in a longitudinal (or axial) direction, and can each have a substantially cylindrical form. They have on their outer surface, for example extending around their circumference, a guide which delimits the axial movement of the carrier disc margins, with the result that the latter are held substantially in the carrier disc plane. The gear arrangements can have corresponding guides. The guide can delimit the movement of the margins of the carrier discs in one or both axial directions, that is to say for example vertically upward and/or downward.

Furthermore, the delimitation can completely prevent the movement in the at least one axial direction or still permit a slight movement. According to the invention, therefore, the undesirable vertical movement of the carrier discs, in particular outside the working gap, is largely avoided by means of the guide. The risk of damage to the carrier discs and the workpieces to be processed is minimized.

The workpieces that are simultaneously processed on both sides by means of the device can be semiconductor wafers, for example. Material removal processing, for example grinding, lapping, polishing or honing, can be effected by means of the device according to the invention, and for this purpose, the working discs can have suitable working layers.

According to the invention, in particular, a plurality of carrier discs can be provided. The latter can in turn have a plurality of cutouts for a plurality of workpieces. The workpieces held in the carrier discs move along a cycloid path in the working gap.

Each pin arrangement can have a guide according to the invention. However, it is also conceivable to provide at least some of the pin arrangements with a guide, but not all. The gear or pin arrangements can be embodied in one part or in multiple parts. In principle, it is conceivable for the pin arrangements to consist in each case only of one pin, on whose outer surface itself the guide is formed. However, it is also conceivable for the pin arrangements to consist of a plurality of parts. In this case, therefore, the expression gear or pin arrangement encompasses not only the pins or gears themselves, but also for example separate component parts which, however, are connected thereto. Likewise, the feature that at least one gear or pin arrangement has a guide also encompasses for example the provision of the guide between adjacent pins or gears, whether or not the guide is connected to the pins or gears.

According to a further embodiment the at least one groove is formed at the larger diameter portion of the pin arrangement. Furthermore the smaller diameter of the pin arrangement can end in a free end of the pin arrangement starting from the shoulder without any diameter enlargement.

It is furthermore preferred if the pin arrangements of at least one of the pin rings are formed in each case from a pin and a sleeve mounted in rotatable fashion on the pin, wherein at least one of the sleeves, in particular all of the sleeves, for example, has the guide on the outer circumference thereof.

The sleeves, which can be embodied in one part or in multiple parts, can be arranged on the pin directly in rotary fashion or can be arranged on the pin for example by means of an inner casing serving as a sliding bearing.

The guide can be incorporated into the sleeve itself. However, it is also conceivable, of course, to arrange on the outer surface of the sleeve a further device, for example a ring or the like, which then forms the guide. Through the use of sleeves, the wear of the carrier discs and of the pin rings can be reduced in a manner known per se. At the same time, the wear and the risk of damage of the carrier discs are minimized further by the guide formed on at least one of the sleeves. The sleeves can be provided in particular on the outer and the inner pin ring or just one of the pin rings. They can furthermore consist for example of a steel material (e.g. a hardened steel material, in particular high-grade steel material). Such a material is particularly resistant to wear. However, it is also conceivable to produce the sleeves from a different material, for example a plastic material. Metal abrasion is avoided by choosing a plastic.

According to one configuration, at least one of the guides can have at least one radially extending guide surface. The guide surface extends in a radial plane, that is to say in particular a horizontal plane. The carrier disc then bears on the radial guide surface during processing and the movement of its margin is thus delimited in at least one axial direction.

Furthermore, the at least one pin arrangement or sleeve can have a plurality of grooves which are spaced apart axially with respect to one another, extend around the circumference of the pin arrangement or sleeve and the side surfaces of which in each case delimit a movement of the margin of the at least one carrier disc in an axial direction. The grooves can in turn extend perpendicular to the longitudinal axis of the pin arrangement or sleeve.

The grooves can furthermore have different widths. In this case, the groove width can be adapted to the thickness of the carrier discs that are to be guided in each case. In this way, by means of a suitable height adaptation of the pin arrangements, carrier discs of different thicknesses can be guided with the same pin arrangements or sleeves. This increases the flexibility of the device.

It goes without saying that the radial guide surfaces, shoulders and/or grooves according to the invention can be combined with one another in any desired manner. Thus, by way of example, the pin arrangements or sleeves can each have at least one such shoulder and/or at least one such guide surface and/or one or a plurality of such grooves. The scope of use of the device is thereby extended. In particular, workpieces having considerably different thicknesses can then also be guided with the same pin arrangements.

According to a further configuration, at least one groove can have a width which is greater than the thickness of the at least one carrier disc to be guided by 0.1 mm to 0.5 mm. This provides a small amount of play for the carrier disc in the groove opening which reduces the wear.

According to a further configuration, the at least one guide surface or the at least one shoulder or the at least one groove can have at least one circumferential bevel. Such a bevel leads to a facilitated entry of the carrier discs into the guide, for example the groove, and thus to a reduced wear. The risk of damage to the carrier discs and the workpieces is thereby reduced. The bevels can be formed at the edge of the shoulder or at one or both edges of the groove opening and in a manner extending around the circumference of the pin arrangement or sleeve. It has proved to be particularly suitable in practice for the bevel to have an opening angle of 10° to 45° relative to the guide surface or relative to the shoulder or relative to the groove.

As an alternative to the provision of bevels, for the same purpose it may also be provided that the at least one guide surface or the at least one shoulder or the at least one groove has at least one rounded edge. In turn, it is correspondingly possible in the case of grooves, of course, for both edges of the groove opening to be rounded.

Owing to the fact that for the carrier discs the risk of damage is minimized according to the invention, it is advantageously possible, in accordance with a further configuration, to produce said carrier discs from a nonmetallic material, in particular a plastic. In the prior art, such nonmetallic carrier discs are virtually impossible owing to the risk of damage to the carrier discs.

According to a further configuration, the gear wheels or pin rings can be mounted by means of a height-adjustable mount, wherein a lifting device is provided for the mount. The height of the gear wheels or pin rings and thus of their gear or pin arrangements can thus be varied. If the gears or pins or sleeves have for example a plurality of guides spaced apart in an axial direction, e.g. grooves and/or shoulders having different thicknesses, by means of the height setting it is possible to set the gear wheels or pin rings to the corresponding carrier discs having different thicknesses.

Objects of the invention are further achieved by a first method according to the invention for the simultaneous double-sided material removal processing of a plurality of semiconductor wafers, in which each semiconductor wafer (1) lies freely mobile in a recess of one of a plurality of carrier discs (5) set in rotation by means of an annular outer drive wheel (7*a*) and an annular inner drive wheel (7*b*) and thereby moved on a cycloid path curve, while the semiconductor wafers (1) are processed so as to remove material between two rotating annular working discs (4*a*) and (4*b*), and the carrier discs (5) and/or semiconductor wafers (1) temporarily leave the working gap, delimited by the working discs (4*a*) and (4*b*), with a part of their surface (6) during the processing, wherein the carrier discs (5) are guided in a movement plane which essentially extends coplanar with a midplane of the working gap by the carrier discs being guided in that movement plane, during the excursion of a part of the area of the carrier discs and/or semiconductor wafers from the working gap, in grooves (15) of a plurality of grooved sleeves (12) mounted on a pin (11) and fitted on at least one of the two gear wheels (7*a*) or (7*b*).

Furthermore, these objects are also achieved by a second method according to the invention for the simultaneous double-sided material removal processing of a plurality of semiconductor wafers, in which each semiconductor wafer (1) lies freely mobile in a recess of one of a plurality of carrier discs (5) set in rotation by means of an annular outer drive wheel (7*a*) and an annular inner drive wheel (7*b*) and thereby moved on a cycloid path curve, while the semiconductor wafers (1) are processed so as to remove material between two rotating annular working discs (4*a*) and (4*b*) which comprise working layers (3*a*) and (3*b*), and the carrier discs (5) and/or semiconductor wafers (1) temporarily leave the working gap, delimited by the working discs (4*a*) and (4*b*), with a part of their surface (6) during the processing, wherein the carrier discs (5) are guided in a movement plane which essentially extends coplanar with a midplane of the working gap by the two working discs (4*a*) and (4*b*) respectively comprising an annular region (18*a*) and (18*b*), which contains no working layer (3*a*) and (3*b*) and ensures guiding of the carrier disc (5) during the excursion of the carrier discs (5) and/or semiconductor wafers (1) from the working gap.

The first and second methods preferably involve double-sided grinding of the semiconductor wafer, each working disc comprising a working layer of abrasive material (in particular PPG methods). In the first method according to the invention, double-sided lapping of the semiconductor wafers, while supplying a suspension which contains an abrasive material, is likewise preferred.

Lastly, the first and second methods according to the invention may also involve double-sided polishing, while supplying a dispersion which contains silica sol, in which case each working disc comprises a polishing pad as a working layer. In fact, no workpiece excursion takes places in double-sided polishing. Nevertheless, the carrier discs emerge from the working gap even in DSP so that guiding the carrier discs according to the first method according to the invention is also advantageous for DSP.

The invention will be described in detail below with the aid of FIGS. 1-14. Unless indicated otherwise, identical reference symbols designate identical objects in the figures.

FIG. 1 shows the basic construction of a device according to the invention for the double-sided processing of flat workpieces.

A double-sided processing machine 42 with planetary kinematics is illustrated in the example in FIG. 1. The device 42 has an upper pivoting arm 43, which can be pivoted about a vertical axis by means of a pivoting device 45 mounted on a lower base 44. An upper working disc 4*b* is carried on the pivoting arm 43. The upper working disc 4*b* can be driven in rotary fashion by means of a drive motor (not illustrated in more specific detail in FIG. 1). On its underside (not illustrated in FIG. 1), the working disc 4*b* has a working surface, which can be provided with a working layer depending on the processing to be effected. The base 44 has a carrier section 8, which carries a lower working disc 4*a*. It likewise has a working surface on its top side. The lower working disc 4*a* can likewise be driven in a rotary fashion by means of a drive motor (not illustrated), in particular in the opposite direction to the upper working disc 4*b*. Arranged on the lower working disc 4*a* are a plurality of carrier discs 5 each having cutouts 25 for workpieces to process, in the present case semiconductor wafers to be processed. In the exemplary embodiment illustrated, the carrier discs 5 consist of a plastic. The carrier discs 5 have outer teeth 10, with which they come into engagement with an inner pin ring 7*b* and an outer pin ring 7*a* of the device. The inner pin ring 7*b* and the outer pin ring 7*a* each have a multiplicity of pin arrangements, which, in the example illustrated, are formed in each case from a cylindrical pin and a sleeve mounted in rotatable fashion on the pin. A rolling device is formed in this way, wherein the carrier discs 5 are likewise set in rotation in the event of a rotation of the lower working disc 4*a* by means of the inner pin ring 7*b*. The workpieces arranged in the cutouts in the carrier discs 5 then move along cycloid paths.

For processing purposes the workpieces to be processed are inserted into the cutouts 25 in the carrier discs 5 (not illustrated). As a result of the pivoting of the pivoting arm 43, the two working discs 4*a*, 4*b* are aligned coaxially with respect to one another. They then form between themselves a working gap, in which are arranged the carrier discs 5 with the workpieces held by the latter. With at least one rotating upper or lower working disc 4*a*, 4*b*, afterward the upper working disc 4*b*, for example, is pressed onto the workpieces by means of a highly precise loading system. From the upper and lower working discs 4*a*, 4*b*, in each case a press-on force thus then acts on the workpieces to be processed and the latter are simultaneously processed on both sides. The construction and the function of such a double-sided processing machine are known per se to the person skilled in the art.

Figure 2:
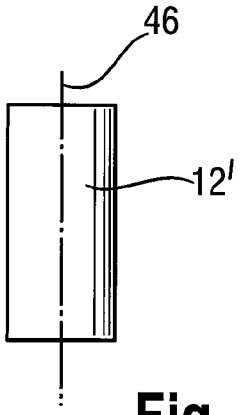
FIG. 2 shows a sleeve for a pin of a pin ring in a side view in accordance with the prior art.

FIG. 2 illustrates a sleeve 12' according to the prior art. The known sleeve 12' has a hollow-cylindrical form and during operation is placed onto the pins of the inner and/or outer pin ring 7*a*, 7*b* of a device as shown in FIG. 1. In this case, it is mounted on the respective pin in a manner such that it can be rotated along the rotation axis 46 illustrated in a dash-dotted manner in FIG. 2.

Figure 3:
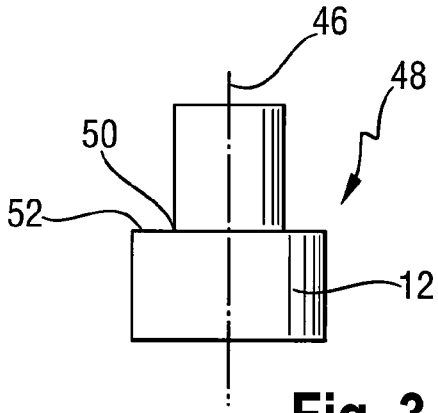
FIG. 3 shows a sleeve according to a first exemplary embodiment of the invention in a side view.

FIG. 3 shows a sleeve 12 according to a first exemplary embodiment of the invention.

The sleeve 12 illustrated in FIG. 3 likewise has a substantially cylindrical cutout by means of which it can be placed onto a pin of the pin rings 7*a*, 7*b*. In this case, in particular all or some of the pins of one or both pin rings 7*a*, 7*b* can be provided with such a sleeve 12. The sleeves illustrated in FIG. 3 have on their outer surface a guide 48, which, in the example illustrated, is formed by a shoulder 50—extending around the circumference of the sleeve 12—between a first, larger diameter and a second, smaller diameter of the sleeve 12. In this case, the guide 48 has a radially extending guide surface 52 as a result of this shoulder 50. During operation, the carrier discs 5 engage by their outer teeth into the region of the sleeve 12 having the smaller diameter, wherein the radial guide surface 52 delimits the movement of the margins of the carrier discs 5 in an axial direction in such a way that an axial movement in the figure downward is prevented.

Figure 4:
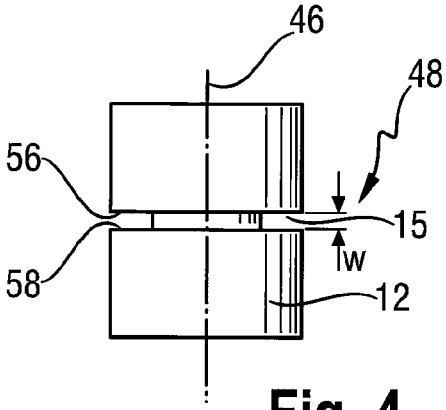
FIG. 4 shows a sleeve according to a further exemplary embodiment of the invention in a side view.

FIG. 4 shows a sleeve 12 according to the invention according to a further exemplary embodiment. As the guide 48, this sleeve 12 has a cross-sectionally rectangular groove 15 extending around the circumference of the sleeve 12. In this case, the carrier discs 5 in turn engage into the region of the sleeve 12 having a smaller diameter, said region being formed by the base of the groove. Side surfaces 56, 58 of the groove 15 form a guide of the margins of the carrier discs 5 in such a way that these can move out of the groove neither in an axial direction upward nor in an axial direction downward. The groove can permit a small amount of play of the carrier discs 5 by virtue of the fact that it has a width w that is greater than the thickness of the carrier disc 5 guided in the groove 15 by 0.1 mm to 0.5 mm.

Figure 5:
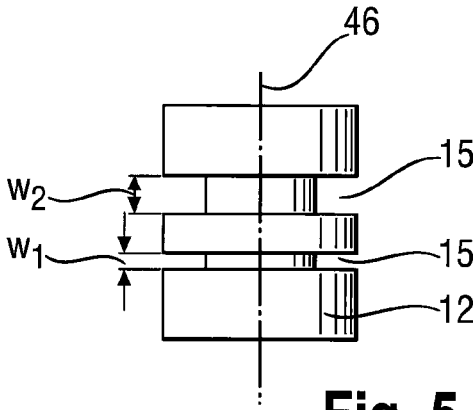
FIG. 5 shows a sleeve according to a further exemplary embodiment of the invention in a side view.

In the case of the exemplary embodiment of a sleeve 12 according to the invention as illustrated in FIG. 5, in contrast to the exemplary embodiment from FIG. 4, two circumferential grooves 15 having different widths w1 and w2 are provided. By means of the two grooves 15, carrier discs 5 having different thicknesses can be guided by the same sleeve 12. For this purpose, in the case of the device shown in FIG. 1, the inner pin ring 7*a* and the outer pin ring 7*b* can be mounted by means of a height-adjustable mount, wherein a lifting device is provided for the mount. By means of the lifting device, it is possible to adjust the height of the pin rings 7*a*, 7*b* and with them the sleeves 12 arranged on the pins. In this way, the pins with the sleeves 12 mounted thereon in rotatable fashion can be aligned with the correct height position for the carrier disc 5 to be guided in each case.

Figure 6:
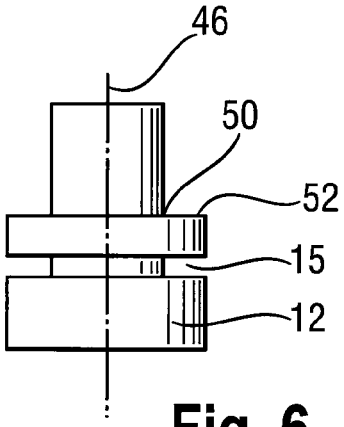
FIG. 6 shows a sleeve according to a further exemplary embodiment of the invention in a side view.

The exemplary embodiment shown in FIG. 6 combines the circumferential shoulder 50 with the circumferential radial guide surface 52 from FIG. 3 with the circumferential groove 15 from FIG. 4, on the other hand. It is once again possible, through a suitable height adjustment by means of the lifting device, with the sleeve 12 illustrated in FIG. 6, both to delimit the movement of a comparatively thin carrier disc 5 on both sides axially in the circumferential groove 15 and to delimit for example the movement of carrier discs or other tools of considerable thickness by means of the radial guide surface 52 of the shoulder 50 on one side axially. This increases the flexibility of the device according to the invention.

Figure 7:
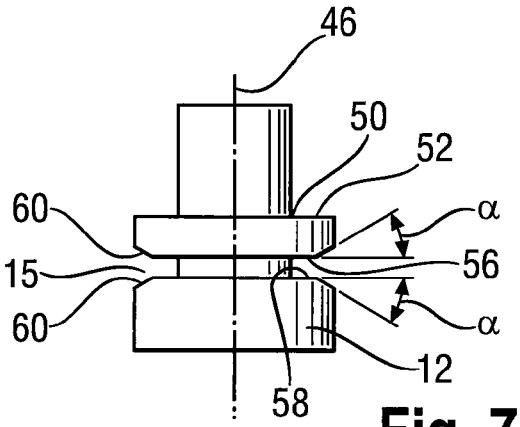
FIG. 7 shows a sleeve according to a further exemplary embodiment of the invention in a side view.

The sleeves 12 illustrated in FIG. 7 largely correspond to the sleeves shown in FIG. 6. In the case of the sleeve 12 in FIG. 7, however, the groove 15 has a circumferential bevel 60 in each case at both edges of its groove opening. The bevels 60 can have an opening angle α of 10° to 45° in each case relative to the groove, and in particular relative to its side surfaces 56, 58. The bevelings of the groove 15 facilitate the receiving of the carrier discs 5 in the groove 15 and reduce the risk of damage to the carrier discs 5. Even though corresponding bevels 60 are provided only at the groove edges in FIG. 7, it is also possible, of course, for the radial guide surface 52 of the shoulder 50 to have a corresponding bevel. Likewise, one or a plurality of corresponding bevels can be provided in the case of the exemplary embodiments of the sleeve 12 as shown in FIGS. 3 to 6. Instead of the bevels, it is also conceivable to round the edges of the grooves 15 and/or of the radial guide surfaces 52.

Figure 8:
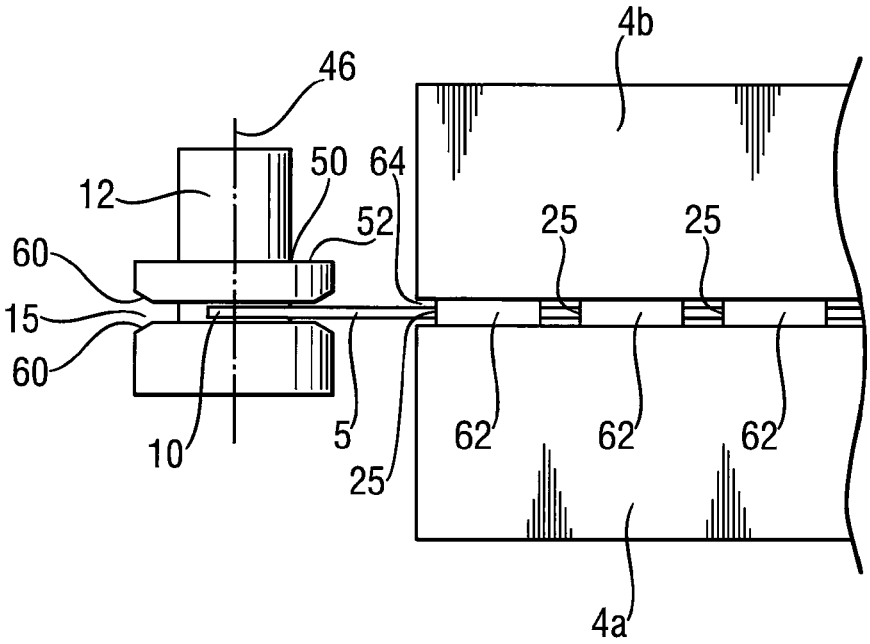
FIG. 8 shows the sleeves illustrated in FIG. 7 in a partial side view in an operating position.

The sleeve 12 illustrated in FIG. 7 is shown partially in an operating position by way of example and extremely schematically in FIG. 8. It goes without saying that the proportions of the individual component parts are not depicted realistically for the illustration. The figure reveals the carrier disc 5, which holds in its cutouts 25 in each case workpieces 62 that are simultaneously processed on both sides in the working gap 64 between the upper working disc 4*b* and the lower working disc 4*a*. The carrier disc 5 is in engagement by its outer teeth 10 with the sleeve 12 and in particular the section formed by the base of the groove within the groove 15 having a smaller diameter. The carrier disc 5 is delimited axially with regard to its movement with a small amount of play in the groove 15 in both directions. A considerable vertical movement of the carrier disc 5 in the region outside the working gap 64 is reliably avoided in this way.

It is pointed out that even though a machine having pin rings (7*a*, 7*b*) is described in the exemplary embodiment illustrated, the pin arrangements correspondingly having a guide for the carrier discs, according to the invention a machine having a gear wheel arrangement, that is to say an inner and outer gear wheel instead of the inner and outer pin ring, could likewise be provided, in which case the gear arrangements can then have corresponding guides.

FIG. 13 shows the plan view of the lower working disc 4*a* of a double-sided processing machine suitable for carrying out the method according to the invention.

The lower working disc 4*a* is represented with the applied lower working layer, consisting of a working layer carrier 2*a* and a working layer 3*a*, and the rolling device formed by the inner pin ring (7*b*) and outer pin ring (7*a*) for the workpiece guide cage ("carrier discs", 5) with inserted workpieces 1 (semiconductor wafers). 11 and 12 denote the pin and pin sleeve of the pin ring.

FIG. 13B depicts a detailed representation of excerpt 28 from FIG. 13A. In order to avoid damage on the semiconductor wafer 1 due to hard contact (fracture, splintering) or contamination with the e.g. metallic material of the carrier disc 5, the reception opening 25 of the carrier disc 5 is lined with a plastic insert 20. On its path over the working layer 3*a*, a part 6 of the semiconductor wafer 1 temporarily projects beyond the inner or outer edge of the working layer owing to the rotation of the carrier disc 5. This is referred to as "workpiece excursion". Since the semiconductor wafer 1 is inserted with play 27 into the reception opening 25 of the carrier disc 5, it can rotate freely so that an annular region 24 of the semiconductor wafer 1 enters into excursion 6 in the course of the processing.

Owing to wear, the working layer experiences a thickness reduction during the processing. This takes place inside the annular surface over which the semiconductor wafers sweep in the course of the processing. When the annular surface lies inside the annular working layer, a "trough-shaped" thickness profile is set up radially over the working layer. This leads to enhanced material removal at the edge of the semiconductor wafer ("edge roll-off"), which is undesired. Yet when the working layer lies fully inside the swept annular surface, the semiconductor wafers experience a workpiece excursion and an edge roll-off does not occur.

A workpiece excursion is known, for example, from DE 102 007 013 058 A1. Owing to a workpiece excursion, the carrier disc also projects over a sizeable length without guiding from the working gap formed by the upper and lower working discs.

The bending of the carrier disc in the prior art and also the guiding of the carrier discs outside the working gap by means of a support ring are illustrated schematically below (FIG. 12).

FIG. 12A shows the cross section through the upper 4*a* and lower working disc 4*b* with an upper 3*b* and lower working layer 3*a* on working layer carriers 2*b* and 2*a*, and a carrier disc 5 with a reception opening 25 for the semiconductor wafer 1, which engages into a pin 11 with a pin sleeve 12 of the outer gear wheel. In the prior art, the carrier disc is not guided in the excursion region 6 and beyond to its outer teeth 10. When the semiconductor wafers are moved during the processing, the rolling device transmits high forces to the carrier discs. The carrier discs then sometimes bend considerably in the unguided excursion region. This is known from lapping, in which a large excursion is preferred.

In PPG methods, the bending is further promoted by the carrier discs consisting only of a thin stiffness-imparting core material 30, for example of steel, which is coated on both sides with an anti-wear coating 29 that does not contribute to the stiffness (FIG. 12C and FIG. 12D). For the PPG method, rolling devices without measures for guiding the carrier discs in the movement plane are therefore unsuitable.

In the prior art without carrier disc guiding in excursion (FIG. 12A), the carrier disc is then sometimes bent (41) so that its outer teeth 10 leave the guiding by the pin 11 and pin sleeve 12 of the pin ring 7*a* and "jump over". Furthermore, the semiconductor wafers 1 sometimes project (17) from the carrier disc 5 so much that they are no longer guided by its reception opening. When the carrier disc 5 rotates further and the working discs 4*a* and 4*b* or the working layers 3*a* and 3*b* force the carrier disc back into the working gap, the edge of the semiconductor wafer may be damaged, or fracture may occur.

In the prior art, suitable carrier discs usually have "plastic insert" which lines the reception opening. An example is shown by FIG. 12C. When the semiconductor wafer is forced back into the reception opening upon re-entering the working gap, as shown by FIG. 12D, the plastic insert 20 therefore often erupts (22) or the semiconductor wafer itself breaks (23). This leads to damage or destruction of the semiconductor wafers and the carrier discs, and usually therefore also damage of the working layers 3*a* and 3*b* owing to fragments of the two in the working gap.

As a suitable countermeasure, FIG. 12B represents a device in the form of a height-adjustable (19) so-called "support ring" 31. Although the support ring can limit excessive bending of the carrier disc in one direction (16), it does not however prevent undesired upward departure from the pin ring guide (41), so that the device according to FIG. 4B does not allow the object of securely guiding the carrier disc without eruption and with low constraining forces in the excursion region to be achieved to a sufficient degree. On the other hand, it prevents unimpeded flow of the cooling lubricant (water) and grinding slurry out from the working gap over the edge of the working disc. This may lead to "aquaplaning" with loss of grinding action, and in particular undesired heating in the working gap. Such heating may lead to deformation of the working discs, which may entail a deterioration of the plane-parallelity achievable for the semiconductor wafers processed in this way. The use of support rings according to FIG. 12B in PPG methods is therefore less preferred.

FIG. 9 shows examples of double-sided carrier disc guiding in excursion.

FIG. 9A shows a lower (13*a*) and an upper guide ring 13*b*, fitted on the height-adjustable outer pin ring 7*a*—and in an identical form on the inner pin ring 7*b* (not shown). They form an opening 32, which is somewhat wider than the thickness of the carrier disc 5 and preferably widens in a funnel shaped so that the carrier disc can easily be "inserted" and, in particular, its outer teeth 10 do not remain hanging from the guide opening 32. In machines suitable for carrying out the method according to the invention, the pin rings 7*a* and 7*b* are height-adjustable (9). The carrier disc guide 13*a* and 13*b* can therefore constantly be readjusted in height so that it is always possible to compensate for a position change of the carrier discs due to wear of the working layers, so that the carrier disc is guided with low forces without forced bending.

FIG. 9B shows the case in which the lower (3*a*) and upper working layer 3*b* have respectively experienced wear 14*a* and 14*b*, so that the plane in which the carrier disc and semiconductor wafer are moved in the working gap is displaced by the amount 26. Readjustment of the guide device 13*a* and 13*b* likewise by this amount 26 then always leads to guiding of the carrier discs without constraining forces in excursion.

The upper carrier disc guide 13*b* may be guided around the pin sleeves 12, as shown in FIG. 9A and FIG. 9B, so that it likewise ensures positioning of the sleeves 12 on the pins 11, or they may be guided through between the sleeves as shown in FIG. 9E. In this case, the pin sleeves 12 project through corresponding openings 34 into the upper carrier disc guide 13*b*.

Further variants consist in fitting the upper carrier disc guide 13*b* on the machine frame 8 (FIG. 9C) or on the upper working disc 4*b* (FIG. 9D). In the former case the upper guide 13*b* cannot be readjusted so that, when tracking the lower guide 13*a*, the guide gap 32 widens in the course of wear of the working layers 3*a* and 3*b* by the amount of the working layer wear, and the carrier disc guiding becomes somewhat "looser". This is not however detrimental since, when using working layers suitable for carrying out the method with typical usable heights of max 1 mm, the carrier disc can in no case bend so much that the semiconductor wafer leaves the reception opening or damages the plastic insert, or the carrier disc can actually disengage from the rolling device.

In the latter case (FIG. 9D), the effect of the wear 14*b* of the upper working layer 3*b* is that the upper carrier disc guide 13*b* presses the carrier disc 5 down somewhat; here again, however, this is not to a detrimental extent. Another disadvantage is the high relative speed of the upper carrier disc guide 13*b* in relation to the lower carrier disc guide 13*a*, and particularly in relation to the carrier discs 5 which rotate essentially with the rotational speed determined by the slowly rotating outer (7*a*) or inner pin ring (7*b*).

FIG. 10 shows exemplary embodiments for carrying out the first method according to the invention.

FIG. 10A shows a pin sleeve 12, which contains circumferential grooves 15. The base circle diameter of the grooving is equal to that of the outer gearing 10 of the carrier disc 5. The grooves or channels 15 are preferably widened outward (33), so that the carrier disc can easily be "inserted" during the rolling process. Also preferably, the pin sleeve 12 is provided with a plurality of channels 15 so that the channels can be changed after wear due to use. According to the invention, preferably only the outer pin ring 7*a* is equipped with channeled sleeves 12, since the torques acting on the carrier disc 5 are higher here and the carrier discs can more easily be placed into the rolling device formed by the outer 7*a* and inner pin ring 7*b* and removed again. It is however also preferred for both pin rings to be equipped with grooved sleeves 12.

FIG. 10B shows the inventive use of grooved sleeves 12 after the occurrence of wear 14*a* of the lower (3*a*) and 14*b* of the upper working layer 3*b*: the displacement 26 of the movement plane of the carrier disc 5 and semiconductor wafer 1 resulting from the wear can be compensated for by height adjustment 9 of the pin ring 7*a*, so that the carrier disc 5 is guided in a planar fashion with low forces and without forced bending. Height adjustment 9 of the pin ring 7*a* is, however, less preferred. When using multiply grooved sleeves 12, it is preferable when changing a carrier disc 5 to place it into another groove or channel 15, cf. FIG. 10F. Height adjustment 9 of the pin ring 7*a* is not absolutely necessary.

FIGS. 10C to 10E show other exemplary embodiments of grooved sleeves 12 according to the invention according to the number of channels 15 (FIG. 10C, FIG. 10D) or, in the case of a simple rolling device, only with fixed pins 11 and without freely rotatable sleeves 12 (FIG. 10E).

The pins 11, or pin sleeves 12, of the inner and outer pin rings 7*a* and 7*b* of the PPG grinding device transmit all the forces required for rolling and movement of the carrier disc 5 in the working gap. High compressive forces therefore occur between the (rotatable) pin sleeve 12 and the flank of the outer teeth of the carrier disc 5, and also friction forces in the case of pin rings 7*a*/7*b* with stiff forces (non-rolling running). The pins/pin sleeves 11/12 and tooth flanks must therefore have a high material strength. The material of the core of the carrier disc 5, which imparts the stiffness necessary for the carrier disc 5 and therefore usually consists of (hardened) steel, another (hardened) metal or a (fiber-reinforced) composite of high-strength plastic, satisfies this strength condition anyway. Similar materials with high strength and low wear are preferred for the pins 11 and pin sleeves 12. The pins 11 and pin sleeves 12 are therefore preferably made of steel or another (hardened) metal, particularly preferably of hard metal (cemented carbides, tungsten carbide etc.). For critical applications, in which contamination of the workpieces by metal abrasion must be avoided, it is also preferable to use sleeves 12 made of a high-strength composite plastic, in particular glass- or carbon fiber-reinforced PEEK (polyether ether ketone) or other thermo- or duromer composite plastics, as well as those made of materials with high abrasion strength and/or low sliding friction, for example fiber-reinforced polyamide ("nylon"), aramid (PAI, PEI), polyacetal (POM), polyphenyl (PPS), polysulfone (PSU).

The embodiment of pin rings in which the pins 11 carry rotatable sleeves 12 that can follow by corotation the relative movement between the gear wheel 7*a*/7*b* and the outer teeth of the carrier disc 5, which occurs during the rolling of the carrier disc 5, is particularly preferred. So that the sleeves 12 can rotate particularly easily and with low wear on the pins 11, the sleeve 12 may also be configured in multiple parts and consist externally of the particularly suitable high-strength material described, which enters into engagement with the carrier disc 5, and internally of a material with a low sliding friction coefficient (for example polypropylene PP, polyethylene PE, polyamide [polyamide 6, polyamide 12, polyamide 6], polyethylene terephthalate PET, polytetrafluoroethylene PTFE ("Teflon"), polyvinylidene difluoride PVDF etc.). The inner sliding layer may be configured in the form of an inner coating, or inner sleeves or rings which are pressed or adhesively bonded in.

Vertically, the sleeves 12 are preferably guided loosely by screwed "caps" of the pins 11 or by a ring connected to the entire outer pin ring 7*a*/7*b*, so that they cannot slip off the pins and are guided on them with a more or less large play in the vertical direction, more or less uniformly in a plane.

The carrier discs 5 preferably consist of hardened material (for example hardened steel), and the engagement surface of the outer teeth with the sleeves 12 of the pin ring 7*a*/7*b* is very small. The pin sleeves 12 therefore experience increased wear. The wear is particularly high in the outer pin ring 7*a*, since high torques are transmitted there (greater lever).

Multiply grooved sleeves 12 are preferably used, since a different channel 15 can be used after wear without having to replace the entire sleeve. FIG. 1 OF shows the use of the lower channel in a sleeve 12, for example after the upper channel has been worn. The channel 15 to be used is selected by placing the carrier disc into the corresponding channel, preferably after height adjustment 9 of the pin rings 7*a* and 7*b*.

In the PPG grinding method, carrier discs are used which are provided with a coating that prevents contact of the (metallic) core of the carrier disc with the abrasive of the working layer. During processing of the workpieces with the PPG grinding method, the carrier discs in the working gap slide over the working layer (grinding pad). Shear and friction forces then occur on the coating of the carrier discs. At contour edges of the coating, these forces are particularly high and particularly detrimental peel forces occur. In order to avoid detachment of the coating or increased wear, in particular on the contour edges of the carrier disc coating, the coating—particularly in the case of only partial surface coating likewise according to the invention—is configured so that the length of the contour edges is as short as possible and the profile of the contour edges has curvatures which are as small as possible. Preferably, therefore, in particular an e.g. annular region along the profile of the outer teeth of the carrier discs is left uncoated. For example, the coating is configured circularly and extended onto the outer teeth only as far as the base circle of the outer teeth. Particularly preferably, the diameter of such a circular coating is even somewhat smaller than the base circle diameter of the outer teeth. (On the other hand, the region left free by the coating must not be so large that parts of the exposed metallic carrier disc core come in contact with the diamond of the grinding pad owing to bending of the carrier disc. The preferred width of the annular region, exposed in addition to the teeth left uncoated inside the base circle of the outer teeth, is therefore 0-5 mm.)

In the preferred embodiment of the present invention for guiding the carrier discs in the region of the workpiece excursion in the form of grooved pin sleeves or pins, the guiding channels come into contact with the carrier disc only along the tooth flanks of the outer teeth. In particular, the grooved pins or pin sleeves therefore never come in contact with the coating of the carrier discs, so that this is spared and not exposed to any additional wear. It is particularly preferable to coat the carrier discs with a thermosetting polyurethane elastomer with a layer hardness of from 50 to 90 Shore A, and particularly preferably from 60 to 70 Shore A.

FIG. 11 shows exemplary embodiments of devices for carrying out the second method according to the invention, in which the guiding of the carrier disc is effected by an annularly removed working layer, i.e. by an annular region of the working disc or the working layer carrier, which comprises no working layer. The working layers suitable for carrying out the second method according to the invention preferably consist of a thicker carrier layer 2*a* (bottom) and 2*b* (top) and thinner working layers 3*a* and 3*b*, which contain abrasive and act so as to remove material. The guiding of the carrier discs in these exemplary embodiments is achieved in that the working layers 3*a* and 3*b* are set back so that the desired workpiece excursion 6 is obtained, but the working layer carrier 2*a* (lower working layer) and 2*b* (other working layer) are formed up to the edge of the working disc or even beyond it, so that the carrier disc 5 can bend only by a small amount 16 before it bears on one of the working layer carriers 2*a* or 2*b*, and further bending is thus prevented. FIG. 11B shows that the deflection with increasing wear 14*a*, 14*b* of the working layers is limited even more effectively. With the working layers suitable for carrying out the method according to the invention, having a low usable height of the working layers, the maximum bending of the carrier discs 5 is preferably so small that their outer teeth 10 always engage into the pin sleeves 12 of the gear wheel 7*a* (outer) and 7*b* (inner; not shown).

Partial coating of the working layer carrier with a working layer, however, is difficult in terms of manufacturing technology.

The embodiment in FIG. 11C is therefore particularly preferred, which uses working layers 3*a* (bottom) and 3*b* (top) and working layer carriers 2*a* and 2*b* in one piece and surface-wide up to the desired size for the necessary workpiece excursion 6, and additional rings 18*a* (lower working disc) and 18*b* (upper working disc) are fitted.

Outer rings 18*a* and 18*b* which are mounted outside the outer edge of the working layer (FIG. 11C), and inner rings which are mounted inside the inner edge of the working layer (not shown), are preferably used.

The outer and inner rings preferably have the same ring width, since the extent of the workpiece excursion "outward" and "inward" is usually identical.

The inner diameter of the outer rings is equal to or greater than the outer diameter of the working layer carriers 2*a*/2*b* with a working layer 3*a*/3*b*, and the outer diameter of the inner rings is equal to or less than the inner diameter of the working layer carriers 2*a*/2*b* with a working layer 3*a*/3*b*.

Most preferably, the outer margins of the outer rings and the inner margins of the inner rings project beyond the outer and inner edges 4*a* (bottom) and 4*b* (top), respectively, and as close as possible to the sleeves 12 on the outer (7*a*) and inner pin ring 7*b* (not shown), so that the carrier discs are guided over a region which is as large as possible and only very small maximum bending of the carrier disc is achieved (16 in FIG. 11C).

The present invention also relates to a semiconductor wafer.

Semiconductor wafers, which are produced by PPG according to the prior art, have a range of undesired properties which makes them unsuitable for demanding applications.

Thus, the migration 21 described in FIG. 12D of the semiconductor wafer 1 out of the reception opening 25 of the carrier disc 5 bent (17) in excursion 6 does not necessarily lead to fracture 23 of the semiconductor wafer, damage of the carrier disc or loss 22 of the plastic insert 20 upon re-entry into the working gap. Often, the semiconductor wafer is simply only forced under temporarily very elevated pressure beyond the outer and inner margins of the lower 3*a* and upper working layer 3*b* and "jumps" back into the reception opening 25 of the carrier disc upon re-entry into the working gap. The grinding effect thereby briefly enhanced in the marginal region leads to characteristic reduced thicknesses in the region of the workpiece excursion.

FIG. 14A shows the radial thickness profile of a semiconductor wafer processed by methods not according to the invention. The local thickness D (in micrometers, μm) is plotted against the radius R (in millimeters, mm). Wherever the semiconductor wafer has experienced an increased grinding effect by the edge of the working layer upon re-entry into the working gap (38), its thickness is reduced (35). Owing to the semiconductor wafer's own rotation in the reception opening of the carrier disc, these "re-entry marks" are then distributed more or less circularly at the distance 38 around the semiconductor wafer. Owing to the forced jumping of the semiconductor wafer back into the reception opening, the plastic insert 20 is often also damaged only locally, usually roughened. The semiconductor wafer's own rotation in the reception opening 25 of the carrier disc is impeded by the increased friction and individual flattenings 40 are formed in the excursion region (FIG. 14C, left) which are shown as a unilateral (asymmetric) thickness reduction in the radial thickness profile of the semiconductor wafer (FIG. 14C, right). FIG. 14C shows this in plan view (left) and in the semiconductor wafer's thickness profile obtained along the section axis A-A' (right).

Furthermore, semiconductor wafers processed by PPG methods not according to the invention often have an anisotropic distribution of the processing marks (grinding cuts) due to the PPG processing. 37 denotes grinding marks which have been imparted with a preferential direction along the grinding tool movement in the excursion region of the semiconductor wafer (FIG. 14D, left). They are noticeable in that they extend with the curvature of the outer or inner margin of the annular working layer and predominantly tangentially to the margin of the semiconductor wafer. This anisotropic finish is not necessarily associated with an asymmetric thickness or shape variation of the semiconductor wafer; rather, it is expressed by local increased roughness and subsurface damage (39 in the thickness profile of FIG. 14D, right).

A semiconductor wafer processed by methods according to the invention, in which the carrier disc was guided in the movement plane without constraint, does not show these defects (FIG. 14B). The thickness profile is symmetrical, and the surface of the semiconductor wafer has an isotropic finish without local roughenings, increased grinding marks or flattenings in the marginal region. In the worst case, only a slight reduction in the thickness of the semiconductor wafer is observed toward the marginal region, although in terms of size and curvature it does not represent any substantial degradation of the high quality of a semiconductor wafer processed according to the invention (36 in FIG. 14B).

The method according to the invention therefore also provides a semiconductor wafer which has particularly good properties in respect of isotropy, rotational symmetry, planarity and constant thickness, and is therefore suitable for particularly demanding applications.

EXAMPLES

A Peter Wolters AC-1500P3 polishing machine was used for the examples. The technical features of such a device are described in DE 10007389 A1. Grinding pads with abrasives firmly bound therein were used. Such grinding pads are disclosed in U.S. Pat. No. 6,007,407 A and U.S. Pat. No. 5,958,794 A.

Monocrystalline silicon wafers with a diameter of 300 mm were provided as workpieces to be processed, which had an initial thickness of 915 μm. In the PPG grinding, material removal of 90 μl m took place so that the final thickness of the silicon wafers after processing was about 825 μm.

The carrier discs used had a steel core with a thickness of 600 μl m and were coated on both sides with a PU anti-wear layer having a thickness of 100 μl m on each side.

The process pressure selected for the working discs was 100-300 daN to simulate different loading situations, and on average gave removal rates of 10-20 μm/min.

Deionized water (DI water) was used as a cooling lubricant with flow rates of between 3 and 20 l/min, adapted to the respectively resulting removal rates and the different heat inputs resulting from this during the processing.

In the first example, a corresponding process was carried out without any carrier disc guiding. Even during the first run, damage of the silicon wafer at the margin occurred owing to the insert being torn out of the carrier disc and a grinding block or parts thereof being torn off.

In a second example, a process was carried out with a removed grinding pad section taken off. No damage of the silicon wafer occurred here, although there was slight roughening of the semiconductor wafers in the outer marginal region. The geometry of the silicon wafers was acceptable.

In a second example, a process was carried out with carrier disc guiding by grooves in sleeves on the outer pin ring. The silicon wafers showed good geometry, a homogeneous micrograph up to the wafer margin, and no damage of the semiconductor wafer edge. Four runs were possible without damage/roughening of the running discs, the insert, the coating and without attack or tearing of the outermost grinding blocks.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. It should be noted that the term "pin" in the claims corresponds to a single part pin as well as pins composed of a plurality of parts, for example, but not by limitation, a pin with a grooved or shouldered sleeve surrounding it.

What is claimed is:

1. A method for the simultaneous double-sided material removal processing of a plurality of semiconductor wafers, comprising abrading front and rear surfaces of the semiconductor wafers, each semiconductor wafer lying freely mobile in a recess in one of a plurality of carrier disks positioned in a working gap delineated by lower and upper annular working layers of respective lower and upper annular working disks, each working disk having at least one outer annular peripheral portion or inner annular peripheral portion extending beyond edges of the annular working layers, the inner and outer peripheral annular portions free of a working layer;

rotating the plurality of carrier disks between an annular outer gear wheel and an inner drive wheel such that semiconductor wafers lying in the plurality of carrier disks traverse a cycloidal path which causes a portion of the carrier disks and optionally also a portion of each of the semiconductor wafers to temporarily exit the working gap; and guiding the carrier disks in a movement plane which extends essentially coplanar relative to a midplane of the working gap by limiting axial movement of the portion of the carrier disk which has temporarily left the working gap, by contact of the portion of the carrier disk which has temporarily left the working gap with the outer annular peripheral portion of the working disk and/or the inner annular peripheral portion of the working disk.

2. The method of claim 1, wherein each of the lower and upper disks further comprise a working layer carrier between the working layer and the respective lower and upper working disks, each working layer carrier extending into or beyond the outer annular peripheral portion of the respective working disk and/or the annular inner peripheral portion of the respective working disk, the working layer carrier in the outer annular peripheral portion of the working disk and/or the inner annular peripheral portion of the working disk limiting axial movement of the portion of the carrier disk which has temporarily left the working gap by contact of the portion of the carrier disk which has temporarily left the working gap with the annular outer peripheral portion and/or the inner annular peripheral portion.

3. The method of claim 1, wherein guiding is effected by mounting guide rings on at least one of the outer annular peripheral portions of each working disk or the inner annular peripheral portions of each working disk, the guide rings optionally extending beyond an outermost edge of each working disk, the guide rings limiting axial movement of the portion of the carrier disk which temporarily leaves the working gap, the guide rings bearing no working layer.

4. The method of claim 3, wherein each working disk comprises a guide ring on the outer annular peripheral portion of the working disk and a guide ring on the inner annular peripheral portion of the working disk.

5. The method of claim 4, wherein both guide rings have the same ring width.

6. The method of claim 3, wherein each working layer has a working layer carrier positioned between the working layer and the working disk.

7. The method of claim 6, wherein the working layer carrier extends beyond the working layer.

8. The method of claim 6, wherein guide rings are mounted outside an outer edge of each working layer and guide rings are mounted inside an inner edge of each working layer.

9. The method of claim 3, wherein a guide ring having an inner diameter is mounted on each working disk, and the inner diameter is equal to or greater than an outer diameter of the working layer on each working disk.

10. The method of claim 3, wherein a guide ring having an outer diameter is mounted on each working disk, and the outer diameter is equal to or less than an inner diameter of the working layer.

11. The method of claim 3, wherein a guide ring having an inner diameter is mounted on each working disk, and the inner diameter is equal to or greater than an outer diameter of the working layer, and wherein a guide ring having an outer diameter is mounted on each working disk, and the outer diameter is equal to or less than an inner diameter of the working layer.

12. The method of claim 1, wherein the material removal processing comprises double-sided grinding of the semiconductor wafers and each working disk comprises a working layer of abrasive material.

13. The method of claim 1, wherein the material removal processing comprises double-sided polishing while supplying a dispersion, which contains silica sol, each working disk comprising a polishing pad as a working layer.

* * * * *